US007025668B2

(12) United States Patent
Petroski et al.

(10) Patent No.: US 7,025,668 B2
(45) Date of Patent: Apr. 11, 2006

(54) GRADIENT POLISHING PAD MADE FROM PAPER-MAKING FIBERS FOR USE IN CHEMICAL/MECHANICAL PLANARIZATION OF WAFERS

(75) Inventors: Angela Petroski, Crawfordsville, IN (US); Richard D. Cooper, Sullivan, IN (US); Paul Fathauer, Sullivan, IN (US); David Perry, Crawfordsville, IN (US)

(73) Assignee: Raytech Innovative Solutions, LLC, Sullivan, IN (US)

( * ) Notice: Subject to any disclaimer, the term of this patent is extended or adjusted under 35 U.S.C. 154(b) by 0 days.

(21) Appl. No.: 10/464,821

(22) Filed: Jun. 18, 2003

(65) Prior Publication Data

US 2004/0072522 A1 Apr. 15, 2004

Related U.S. Application Data

(63) Continuation-in-part of application No. 10/349,201, filed on Jan. 22, 2003, now Pat. No. 6,852,020.

(60) Provisional application No. 60/402,602, filed on Aug. 12, 2002, provisional application No. 60/389,354, filed on Jun. 18, 2002.

(51) Int. Cl.
*B24B 1/00* (2006.01)

(52) U.S. Cl. ..... 451/526; 451/527; 451/56; 451/41; 51/298; 51/295

(58) Field of Classification Search ..... 451/37, 451/56, 58, 41, 59, 72, 526, 527, 548, 550; 51/298, 295, 293, 309
See application file for complete search history.

(56) References Cited

U.S. PATENT DOCUMENTS

| | | | | |
|---|---|---|---|---|
| 3,499,250 | A | 3/1970 | Jensen et al. | |
| 3,504,457 | A | 4/1970 | Jacobsen et al. | |
| 4,927,432 | A | 5/1990 | Budinger et al. | |
| 5,212,910 | A | 5/1993 | Breivogel et al. | |
| 5,257,478 | A | 11/1993 | Hyde et al. | |
| 5,287,663 | A | 2/1994 | Oierce et al. | |
| 5,304,223 | A * | 4/1994 | Pieper et al. | 51/293 |
| 5,435,816 | A * | 7/1995 | Spurgeon et al. | 51/295 |
| 5,609,517 | A | 3/1997 | Lofaro | |
| 6,022,264 | A * | 2/2000 | Cook et al. | 451/37 |
| 6,062,968 | A | 5/2000 | Sevilla et al. | |

(Continued)

FOREIGN PATENT DOCUMENTS

EP 0 465868 B1 10/1996

*Primary Examiner*—Lee D. Wilson
*Assistant Examiner*—Anthony Ojini
(74) *Attorney, Agent, or Firm*—Milton S. Gerstein; Much,Shelist,Freed

(57) ABSTRACT

A composite polishing pad for use in chemical-mechanical planarization (CMP) processes, which polishing pad of the invention is made of a paper-making-process produced fibrous-matrix of paper-making fibers bound with resin material, and consists of a top section with one or more lower sections, where each layer has unique material properties. Polishing performance can be substantially improved by modifying the individual characteristics of each layer. Typically, the top layer or working surface will be of a higher modulus material than the lower layers. Therefore, the sub-layers may consist of lower density regions or a modified surface structure, such as grooving, to effectively modify the bulk modulus.

4 Claims, 3 Drawing Sheets

U.S. PATENT DOCUMENTS 6,071,178 A 6/2000 Baker, III
6,099,394 A 8/2000 James et al.
6,099,954 A 8/2000 Urbanavage et al.
6,126,532 A 10/2000 Sevilla et al.
6,210,254 B1 4/2001 Cook et al.
6,284,114 B1 9/2001 Chechik et al.
6,293,852 B1 9/2001 Roberts et al.
6,299,516 B1 * 10/2001 Tolles ..... 451/287
6,300,247 B1 * 10/2001 Prabhu ..... 438/691
6,362,107 B1 3/2002 Shiro et al.
6,383,066 B1 5/2002 Chen et al.
6,402,591 B1 6/2002 Thornton
6,419,556 B1 7/2002 Urbanavage et al.
6,425,803 B1 7/2002 Baker, III
6,464,576 B1 10/2002 Freeman et al.

* cited by examiner

GRADIENT POLISHING PAD MADE FROM PAPER-MAKING FIBERS FOR USE IN CHEMICAL/MECHANICAL PLANARIZATION OF WAFERS

CROSS REFERENCE TO RELATED APPLICATIONS

Priority of provisional applications, Nos. 60/389,354, filed on Jun. 18, 2002, and 60/402,602, filed on Aug. 12, 2002, is herewith claimed. The present application is also a continuation-in-part of copending application Ser. No. 10/349,201, filed on Jan. 22, 2003. Reference is also had to copending application Ser. No. 10/087,223, filed on Mar. 1, 2002, which application is incorporated by reference herein.

BACKGROUND OF INVENTION

In above-mentioned copending parent application Ser. No. 10/349,201, there is disclosed a polishing pad for use in chemical-mechanical polishing (CMP) of semiconductor wafers. The polishing pad thereof is made of a porous, fibrous structure bound by a thermoset resin and which is produced by a paper-making, wet laid process.

As in any polishing pad for use in CMP processes, the mechanical removal component is an important factor. However, there are some side effects associated with this mechanical component that also affect the chemical component of the CMP process and the chemical interactions associated therewith. Mechanical pad-properties have significant effects on polishing performance. Therefore, pads are manufactured for specific properties such as stiffness, roughness, compressive modulus, storage/loss modulus (viscoelastic behavior) and hydrophilic properties. Since polishing performance is measured by numerous metrics, modifying particular physical properties of the pad can affect more than one performance-characteristic.

There are many examples of prior-art CMP polishing pads that are a composite of two or more layers, in order to provide a polishing pad having different characteristics, such as hardness. Examples of such prior-art, multi-layer, CMP polishing pads are shown in U.S. Pat. Nos. 5,212,910, 5,257,478, 5,287,663, 6,210,254, and 6,383,066.

SUMMARY OF THE INVENTION

It is the primary objective of the present invention to provide a polishing pad for use in chemical-mechanical polishing (CMP) of semiconductor wafers made of porous, fibrous, structure bound by a thermoset resin and which is produced by a paper-making, wet laid process of copending parent application Ser. No. 10/349,201 and which is provided with at least two layers of different modulus-characteristics.

It is the primary objective of the present invention to provide the polishing pad for use in chemical-mechanical polishing (CMP) of semiconductor wafers made of porous, fibrous, structure bound by a thermoset resin and which is produced by a paper-making, wet laid process of copending parent application Ser. No. 10/349,201 with different modulus-characteristics along the depth of the polishing pad.

In the first embodiment of the polishing pad of the present invention, the pad consists of two layers of different moduli. In a second embodiment, the polishing pad has a working surface that has a higher modulus, or stiffer, matrix-surface than the rest of the pad, which modulus changes in the z-direction through the pad to a lower modulus, or softer, compliant matrix at the platen-side. In this version, the pad of this invention does not have distinct layers that require bonding together. The polishing pad of this version is, therefore, made as a gradient, which is characterized by a variation of physical properties within a non-layered base matrix, thereby creating a pad with desirable properties on the polishing or working side of the pad, and different physical properties on the platen side of the pad. This variation may be a gradual change throughout the pad, or it may be a non-uniform, discontinuous variation.

BRIEF DESCRIPTION OF THE DRAWINGS

Reference is had to the accompanying drawing, wherein.

DETAILED DESCRIPTION OF THE PREFERRED EMBODIMENTS

Figure 1:
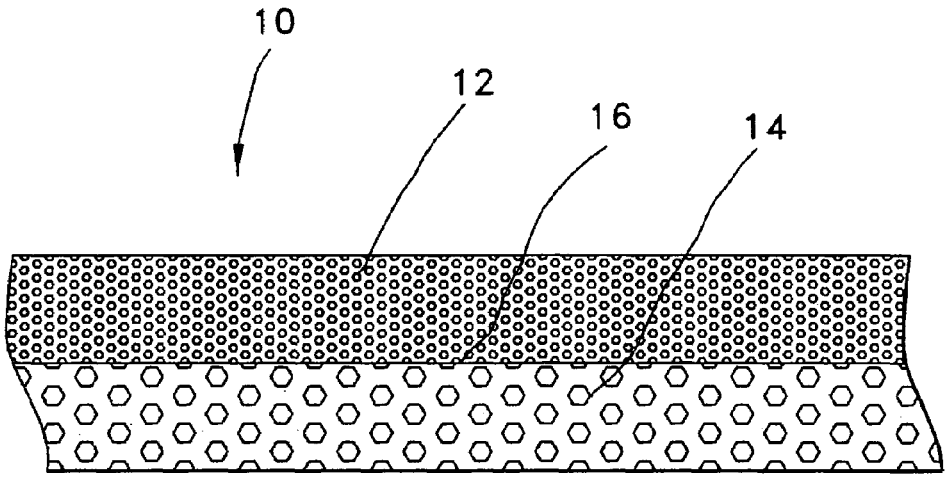
FIG. 1 is a partial cross-sectional view of the first embodiment of the polishing pad of the invention showing a multilayer polishing pad.

Referring now to the drawings in greater detail, the polishing pad of the invention is made of porous, paper-making fibers bound by a thermoset resin, and produced by a paper-making, wet laid process, as disclosed in copending parent application Ser. No. 10/349,201. As disclosed therein, the structure of the polishing pad thereof is a matrix of paper-making fibers impregnated with a thermoset resin, preferably phenolic, is densified if required, cured, ground, and grooved to provide a rigid, yet porous structure. The cross-sectional diameter of the fibers of the polishing pad thereof is preferably approximately between 10–50 microns, with a preferred range of between 15–35 microns, with a length thereof in the range of between 2–15 millimeters. After curing the resin, one or both surfaces are ground to create asperities, thus forming a polishing surface with random polishing sites and flow channels for optimum distribution of the polishing slurries used in chemical mechanical planarization of semiconductor wafers. The polishing pad thereof is produced using a wet-laid paper making process. The preferred fiber for producing the wet laid, fibrous structure is cellulose fiber, and, in particular, cotton linters and lyocell fibers. Other fibers that may be used are cotton, other cellulose fibers such as wood pulp, glass, linen, aramid, polyester, polymer, carbon, polyamide, rayon, polyurethane, phenolic, acrylic, wool, and any natural or synthetic fiber or blends thereof.

In FIG. 1, a two-layer polishing pad 10 is shown, consisting of an upper layer 12 of a higher modulus and a lower-modulus layer 14 affixed to the upper layer by means of adhesive 16. In this design, the top pad provides the properties required for removal rate, planarization of the wafer, uniformity of the wafer polish and defectivity. The bottom layer provides for pressure uniformity on the wafer, edge effects on the wafer and removal rate. The bottom layer may also dissipate energy from the oscillating polishing pressure. This energy may be converted to heat, which aids the chemical mechanisms in the CMP process. Each layer 12, 14 is produced separately and independently by any of the paper-making processes disclosed in parent application Ser. No. 10/349,201, and secured by the adhesive 12, with each layer having its own modulus characteristic.

Figure 2:
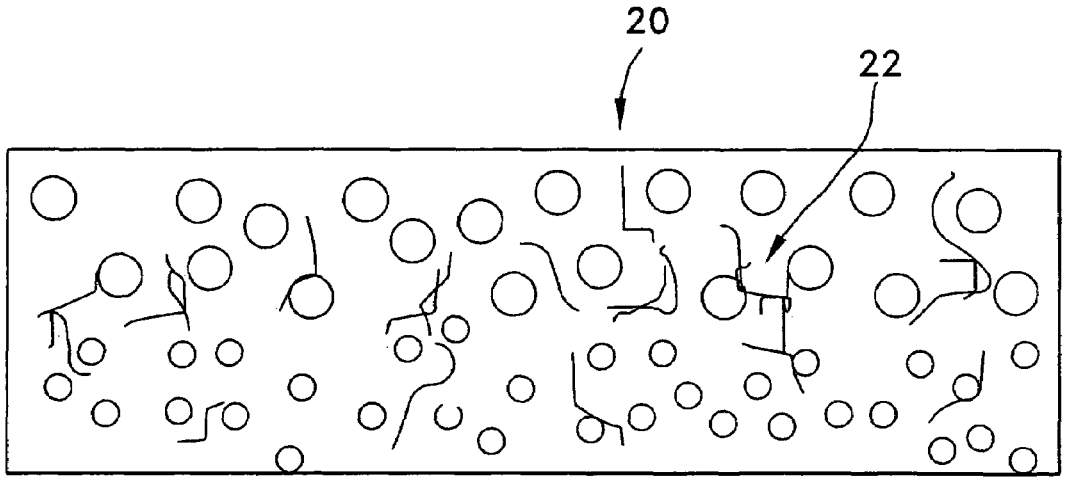
FIG. 2 is a partial cross-sectional view of a second embodiment of the polishing pad of the invention showing a one-piece, single-layer, gradient polishing pad having different modulus along the depth the pad.

FIG. 2 shows a modification of the first embodiment of the polishing pad of the invention. The two-layer polishing pad 20 is made during the wet-laid paper-making process utilizing a dual headbox paper machine system, where the top and bottom sheets are made of different fibrous matrix compositions. When the two sheets are brought together while they are very wet, they are bound together at the interface by entanglement of the fibers, as indicated by reference numeral 22 in FIG. 3. This process produces a material that has two different layers, bound together at the interface by entanglement of the fibers. The different layers have different porosity, density, and different formulations. The two-layer pad of the invention may also be produced by the use of two head boxes, as disclosed in parent application Ser. No. 10/349,201, or as disclosed in above-mentioned, copending application Ser. No. 10/087,223. The fibers may also be intermingled through mechanical means of fiber entanglement such as needling or hydro-entanglement, both of which eliminate distinct layers in the base material. In any case, the two layers are then saturated or impregnated with a thermoset and/or thermoplastic resin. Because of the porosity and/or density variation of the base material, resin penetration changes from high to low within the material, resulting in a harder polishing surface having a softer, more compliant platen surface. The high-density and low-density layers may be reversed so that the high-density layer is the bottom layer.

Figure 3:
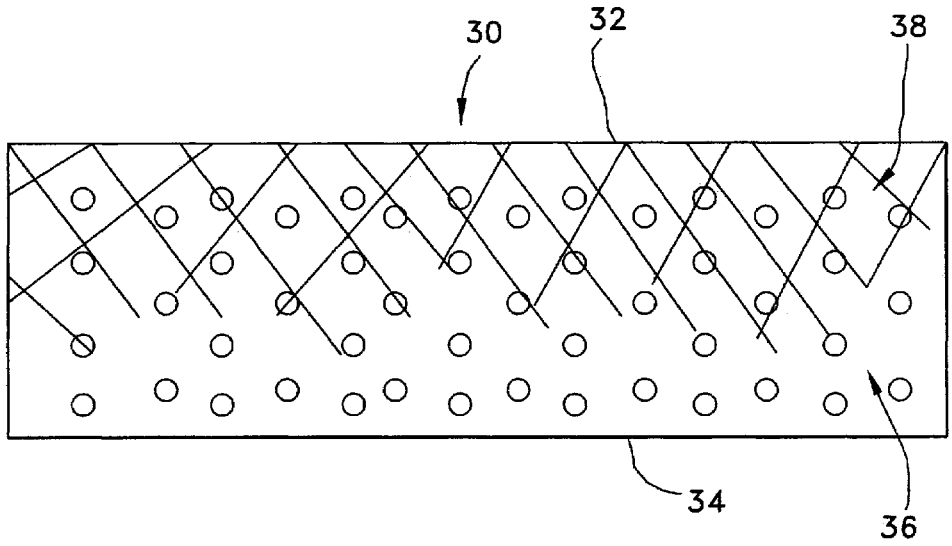
FIG. 3 is a partial cross-sectional view of a modification of the second embodiment of the polishing pad of the invention.

Referring to FIG. 3, there is shown a second embodiment. The polishing pad 30 is a single fibrous matrix, as that in parent application Ser. No. 10/349,201. However, the pad 30 of FIG. 3 differs in that one surface, generally the working surface, 32 has a higher modulus (a stiffer, harder matrix) that graduates in the z-direction, through the pad, to a lower modulus material (a softer, compliant matrix), and does not consist of multiple layers adhered together with adhesive or fiber-entanglement, as in the first embodiment. This polishing pad 30 is termed a gradient material, which is characterized by a variation of physical properties within a non-layered base fibrous matrix, thereby creating a pad with desirable properties on the polishing or working side of the pad, and different physical properties on the platen side of the pad. This variation may be a gradual change throughout the pad, or it may be a non-uniform, discontinuous variation. The one-piece, integral polishing pad 30 is made of porous, paper-making fibers bound by a thermoset or thermoplastic resin, and produced by a paper-making, wet laid process, as disclosed in parent application Ser. No. 10/349,201, or as disclosed in above-mentioned, copending application Ser. No. 10/087,223. Typically, the polishing surface 32 will have a greater modulus, or hardness, than the platen-attaching surface 24 although in some limited environments, the opposite may hold. The gradient polishing pad 30 is made by controlling the depth of penetration of the thermoset or thermoplastic resin binder into the porous fibrous matrix. This process creates a gradient material that does not have distinct layers, cannot be precisely pulled or cut apart, and does not require adhesive to maintain the composite structure between areas of different physical properties. The depth of penetration of the resin binder into the fibrous base matrix may be accomplished during the immersion of the wet-laid sheet, produced during the paper-making process, in a bath of thermoset resin, or when the saturated resin-impregnated sheet is passed through the wiper rollers as disclosed in above-mentioned application Ser. No. 10/087,223. This leaves a lower section 36 having resin-deficient areas and an upper section 38 with resin-rich areas.

Figure 4:
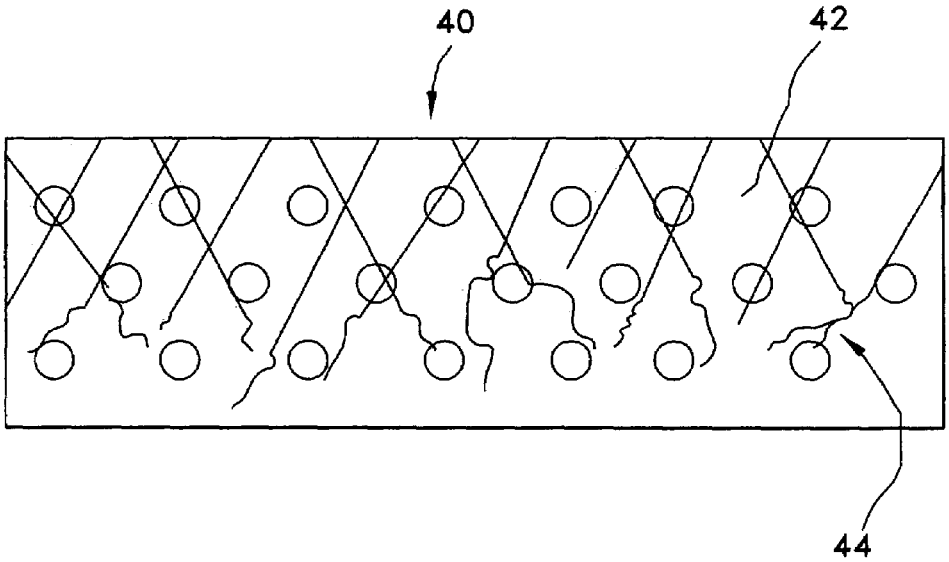
FIG. 4 is a partial cross-sectional view of another modification thereof.

Referring to FIG. 4, there is shown a modification 40 of the second embodiment of the gradient pad. The gradient polishing pad 40 is made by using solvents. A solvent is used to penetrate the uniform base fibrous matrix material 42, generally consisting of fibers with fillers, and/or resin. As the solvent dissolves parts 44 of the base fibrous matrix material 42, the depth of penetration is controlled, resulting in a gradient material that does not have distinct layers. A specific example is the use of methylethylketone (MEK) as a solvent to dissolve resin that has not fully cured or set within a fiber/resin base material, as disclosed in parent application Ser. No. 10/349,201, or as disclosed in above-mentioned, copending application Ser. No. 10/087,223. The surface that has initial contact with the solvent will dissolve the most, leaving mostly fibers. As the solvent penetrates into the pad matrix, it will continue to dissolve resin until removed.

Alternatively, a gradient polishing pad may be formed by selectively saturating the fiber matrix with different resins. For example, a harder thermoset resin may be used on the top surface, and softer thermoplastic resin on the bottom surface, when the fibrous sheet is saturated, as described in parent application Ser. No. 10/3492,201, and above-mentioned application Ser. No. 10/087,223.

While specific embodiments of the invention have been shown and described, it is to be understood that numerous changes and modifications may be made therein without departing from the scope and spirit of the invention as set forth in the appended claims.

What is claimed is:

1. A polishing pad having a polishing surface for use in a CMP process comprising:

a fibrous-matrix produced by a paper-making, wet laid process comprising paper-making fibers bound with resin material; said polishing surface having voids in which CMP polishing slurry flows during chemical mechanical polishing of substrates;

said fibrous-matrix comprising at least a first section defining said polishing surface, said first section having a first modulus-characteristic;

said fibrous-matrix comprising at least a second section defining a platen-attaching surface for attachment to a platen of a CMP apparatus, said second section having a second modulus-characteristic different from said first modulus-characteristic.

2. The polishing pad for use in a CMP process according to claim 1, wherein said fibrous-matrix comprises a one-piece, single-layer, integral fibrous matrix;

said first section having said resin material therein of a first density;

said second section having said resin material therein of a second density different from said first density, whereby said first and second modulus-characteristics are provided.

3. The polishing pad for use in a CMP process according to claim 1, wherein said first modulus-characteristic is greater than said second modulus-characteristic.

4. The polishing pad for use in a CMP process according to claim 1, wherein said fibrous-matrix comprises a one-piece, single-layer, integral fibrous matrix;

said first section having said resin material therein of a first hardness;

said second section having said resin material therein of a second hardness different from said first hardness, whereby said first and second modulus-characteristics are provided.

* * * * *